US005173985A

United States Patent [19]

Palmer

[11] Patent Number: 5,173,985

[45] Date of Patent: Dec. 29, 1992

[54] FOOT MOUNTED SCRUBBER DEVICE

[76] Inventor: Nancy K. Palmer, 10514 Andora Ave., Chatsworth, Calif. 91311

[21] Appl. No.: 668,927

[22] Filed: Mar. 13, 1991

[51] Int. Cl.[5] ..... A47L 13/282

[52] U.S. Cl. ..... 15/227; 51/391

[58] Field of Search ..... 15/227, 104.94; 36/7.7; 51/391

[56] References Cited

U.S. PATENT DOCUMENTS 3,526,014 9/1970 Edwards ..... 15/227
3,680,170 8/1972 Sims ..... 15/227
3,699,672 10/1972 Sims ..... 15/227

*Primary Examiner*—Edward L. Roberts
*Attorney, Agent, or Firm*—Kelly, Bauersfeld & Lowry

[57] ABSTRACT

A foot mounted scrubber device is provided for use in scrubbing and cleaning selected problem areas of a floor, and along adjacent baseboard surfaces and the like. The scrubber device comprises a relatively flat sole plate, in combination with a toe upper and an elastic heel strap for securely mounting the sole plate onto a shoe in a position underlying the ball region and toes of a user's foot. The sole plate defines an abrasive scrubber surface which can be applied against a problem area to be cleaned through the use of the leg muscles in combination with the user's body weight. In a preferred form, the sole plate and toe upper cooperatively define a pointed forward toe lined with an abrasive scrubber material for use in cleaning baseboard surfaces and corners and the like along the edge of the floor.

12 Claims, 1 Drawing Sheet

FOOT MOUNTED SCRUBBER DEVICE

BACKGROUND OF THE INVENTION

This invention relates generally to cleaning implements particularly for use in a household cleaning environment or the like. More specifically, this invention relates to an improved scrubber device for use in scrubbing and cleaning selected problem areas of a hard floor surface, and for cleaning otherwise difficult to reach baseboard surfaces and corners along the edge of a floor.

A wide variety of household cleaning implements are well known in the art for use in performing traditional household cleaning tasks. In this regard, relatively hard floor surfaces constructed from materials such as linoleum or ceramic tile, vinyl floor covering materials, wood and the like are widely used in kitchens and bathrooms and other rooms in a typical residential dwelling. Such hard floor surfaces are also used extensively in many business and commercial facilities. Such hard floor surfaces beneficially accommodate relatively high foot traffic with minimal visible wear, and further are conducive to periodic cleaning by use of water-based detergents, cleaning solvents, and the like.

Conventional cleaning implements used to scrub and clean hard floor surfaces include a wide variety of mop devices equipped with a suitable mop head formed from fabric, sponge, or similar absorbent material for wiping a cleaning solution over the floor surface. However, many hard floor surfaces include minor surface irregularities in the form of pits and crevices within which dirt, particulate and other debris can become trapped such that removal with the use a traditional soft surface mop head can be difficult or impossible. In addition, some types of spills such as dried food particles and the like can adhere to the floor surface and thus be difficult to remove with a conventional mop. Moreover, many hard surface floors include corners or are otherwise associated with adjacent baseboard surfaces which are extremely difficult to access with a traditional mop device for cleaning purposes.

Accordingly, it is often necessary to resort to alternative cleaning methods on a periodic basis to maintain a hard surface floor in a desirable clean condition, wherein such alternative cleaning devices normally entail the use of hand scrubbers and brushes and the like. These hand-operated cleaning devices unfortunately and undesirably require the user to crawl about on the floor on hands and knees, and exert considerable muscular effort with the arms and back. In a household cleaning environment, such manual scrubbing of a floor surface constitutes a difficult and laborious task which can damage the appearance of a person's hands and nails.

The present invention provides an improved floor scrubber device designed for facilitated and effective cleaning of selected problem areas associated with a hard floor surface, wherein the scrubber device is adapted to mount upon a person's shoe such that substantial and vigorous scrubbing forces can be applied to a selected area of the floor through the use of the user's leg muscles and body weight.

SUMMARY OF THE INVENTION

In accordance with the invention, a foot mounted scrubber device is provided for strap-on mounting onto the shoe of a person and for use in scrubbing and cleaning selected problem areas associated with a hard floor surface. The scrubber device is particularly designed to be used in conjunction with traditional mop implements, and to provide an alternative cleaning device for exerting substantial scrubbing forces to selected problem areas and/or areas which are otherwise difficult to reach and clean with a mop. The foot mounted scrubber device beneficially permits such problem areas to be effectively cleaned through the use of a person's leg muscles and body weight, and without requiring the person to bend over or assume a position on the hands and knees.

The foot mounted scrubber device of the present invention comprises a relatively flat sole plate having a size and shape to underlie the ball and toe region of a user's shoe, particularly such as a rubber soled shoe. The sole plate defines an abrasive scrubber material presented downwardly for scrubbing engagement with a floor surface. A rearwardly open toe upper is connected to a forward end of the sole plate and cooperates therewith for mounting the scrubber device onto the front of the user's shoe. An elastic strap which is preferably adjustable in length extends rearwardly from opposite sides of the sole plate, to extend around the heel of the user's shoe and thereby securely retain the scrubber device on the user's shoe.

In accordance with further aspects of the invention, the sole plate preferably comprises a porous abrasive material in combination with a plastic or rubberized resilient mounting base which may be provided in the form of longitudinally extending and transversely spaced parallel strips. The base strips define an array of openings which facilitate rinsing or washing of dirt and debris from the porous abrasive material of the scrubber device, subsequent to use.

The sole plate and toe upper further define a forwardly extending, generally pointed toe on the scrubber device. Additional abrasive scrubber material extends along the opposite sides of the toe in the form of an upstanding side strip, wherein this side strip and pointed toe facilitate cleaning of corners and other difficult to reach baseboard surfaces and the like.

Other features and advantages of the present inventions will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
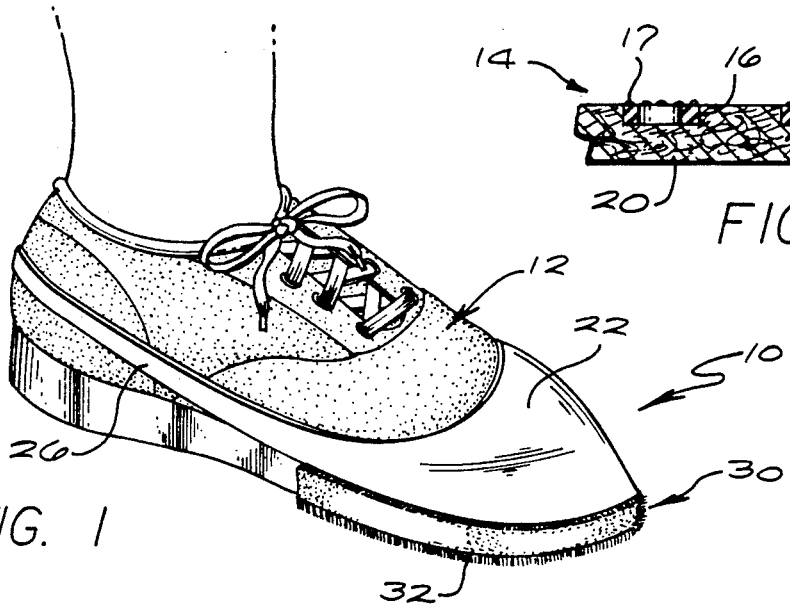
FIG. 1 is a perspective view illustrating a foot mounted scrubber device embodying the novel features of the invention, shown mounted onto a user's shoe.

As shown in the exemplary drawings, a foot mounted scrubber device referred to generally in FIG. 1 by the reference numeral 10 is provided for strap on mounting onto the shoe 12 of a person in the course of cleaning a hard floor surface or the like. The scrubber device 10 provides abrasive scrubber surfaces disposed beneath the ball and toe region of the user's foot, such that the user's leg muscles and body weight can be employed to exert substantial and vigorous scrubbing forces to a selected problem area associated with the surface floor.

The improved foot mounted scrubber device 10 of the present invention is particularly designed for use in conjunction with traditional floor cleaning implements, such as a mop and associated liquid cleaning solution. The scrubber device 10 is designed for facilitated mounting onto the user's shoe 12, such that the scrubber device 10 is ready for immediate use to clean problem areas of the floor but does not obstruct normal movements of the individual to clean the floor in a conventional manner. When a problem area is located, typically involving a localized concentration of dirt, debris, dried food, heel marks, etc., which cannot be satisfactorily cleaned with a mop or the like, the scrubber device 10 can be immediately employed to exert substantial scrubbing action to the localized area and without requiring the user to bend over or manipulate cleaning implements with the hands. The scrubber device 10 is particularly suited for cleaning problem areas on hard surface floors having surface irregularities within which dirt and debris can be trapped, and further for accessing otherwise difficult to reach areas such as corners, baseboard surfaces, beneath cabinet and appliance edges, etc.

Figure 4:
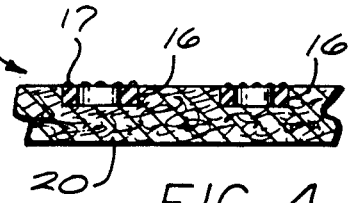
FIG. 4 is an enlarged fragmented transverse vertical sectional view taken generally on the line 4—4 of FIG. 3.
Figure 2:
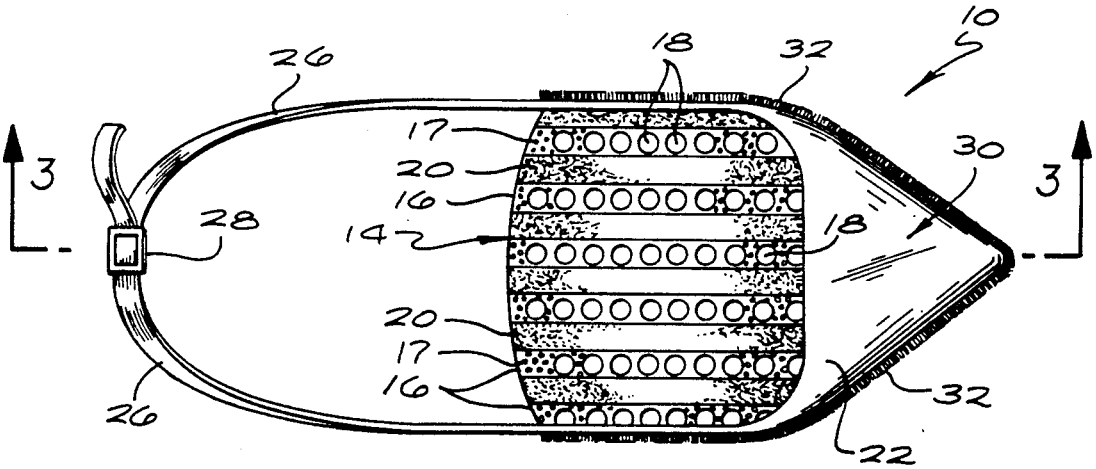
FIG. 2 is an enlarged top plan view of the scrubber device.
Figure 3:
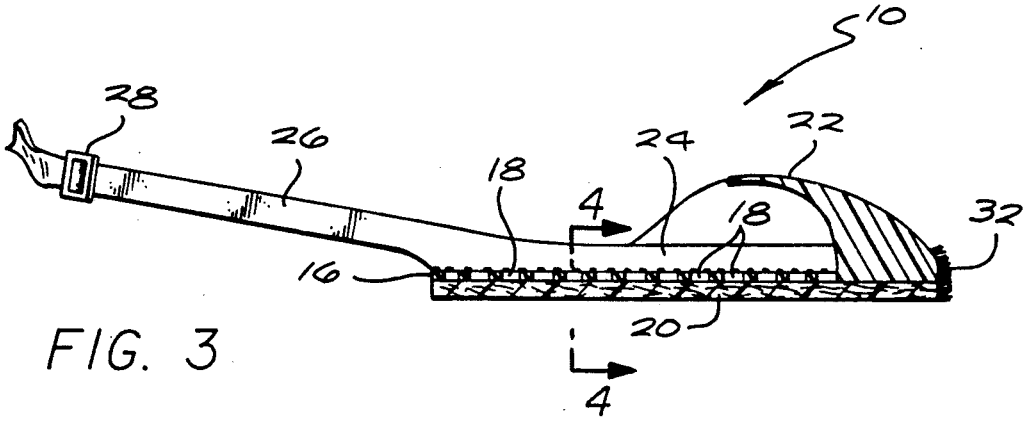
FIG. 3 is a longitudinal vertical sectional view taken generally on the line 3—3 of FIG. 2.

As shown best in FIGS. 2–4, the scrubber device 10 comprises a relatively flat sole plate 14 having a size and shape generally to fit beneath the ball and toe region of the user's shoe 12. The illustrative sole plate 14 is constructed in the form of a plastic or rubberized resilient base 16 shown as longitudinally elongated strips having a roughened or dimpled upper surface 17 and a plurality of relatively small openings 18 formed therein. Alternatively, the base 16 may be constructed as a continuous plastic or rubberized sheet layer, if desired.

The sole plate 14 further includes a pad 20 or similar structure comprising a selected abrasive scrubber material. Although a wide variety of different abrasive scrubber materials may be used, one preferred scrubber material comprises an abrasive pad marketed by Minneapolis Mining and Manufacturing Company (3M) of St. Paul, Minn. under the name Scotch-Brite. This abrasive pad has a size and shape for substantially uninterruptedly underlying the ball and toe region of the user's shoe 12, and for contacting a hard floor surface with a substantial scrubbing action, as will be described in more detail.

A contoured toe upper 22 is mounted or otherwise suitably formed at a forward end of the sole plate 14 and extends upwardly and rearwardly therefrom with a generally shell-shaped, rearwardly open construction for overlying a toe region of the user's shoe 12. This toe upper 22 merges along the side edges of the sole plate 14 with a relatively short upstanding side rim 24 (FIG. 3) of plastic or rubberized material, wherein the toe upper 22 and side rim 24 cooperate with the sole plate 14 for snugly receiving the ball and toe region of the user's shoe. Elongated resilient or elastic straps 26 extend rearwardly from the side rim 24 at the opposites sides of the sole plate 14, and with a slight inclination angle for interconnection at the rear of the shoe heel by means of a buckle 28 or the like. The combined length of the heel straps 26 is appropriately adjusted to snugly retain the scrubber device 10 mounted upon the shoe 12.

In accordance with further aspects of the invention, a forward end of the sole plate 14 cooperates with a forwardly pointed portion of the toe upper 22 to define a relatively pointed forward toe 30. A side strip 32 of additional abrasive scrubber material is mounted on the exterior of the forward toe 30, and extends continuously therefrom along both sides of the sole plate 14. The combination of the pointed forward toe 30 with the side abrasive strip 32 permits the scrubber device to be employed in abrasive cleaning of relatively small areas such as floor corners, baseboard zones, etc. which are otherwise difficult to reach and clean with traditional floor cleaning implements.

In use, when a selected floor problem area is located, the abrasive pad 20 at the underside of the sole plate 14 can be scrubbed vigorously with substantial force to dislodge dirt and debris. Importantly, this vigorous scrubbing action can be obtained without requiring a person to bend over or to manipulate hand-operated scrubber devices. Substantial scrubbing force is available through the use of the person's leg muscles in conjunction with the person's body weight thereby providing an optimum scrubbing action without subjecting the user to muscle strain of the hands, arms or back. The combination of the toe upper 22 and the heel straps 26 securely hold the abrasive pad 20 in place beneath the user's foot during this scrubbing action. The dimpled upper surface 17 on the base 16 further assists in retaining the sole plate securely in place without slippage relative to the user's shoe, particularly when the shoe 12 has a rubberized or resilient sole engaged with the dimpled surface 17.

Subsequent to use, the scrubber device 10 is easily removed from the user's shoe 12 by slipping the straps 26 off the shoe heel and then pulling the device forwardly from the shoe toe. The soiled scrubber device may then be washed or cleaned with running water from a faucet or by placement into a conventional clothes washer or the like. In either case, the array of openings 18 in the sole plate 14 permits enhanced dirt removal from the scrubber device by flushing flow through the porous structure.

The improved scrubber device 10 of the present invention thus provides a relatively simple and easy to use device for applying a significantly improved scrubbing action to problem areas of a hard floor surface or the like.

A variety of modification and improvements to the scrubber device 10 of the present invention will be apparent to persons skilled in the art. Accordingly, no limitation on the invention is intended by way of the foregoing description and accompanying drawings, except to set forth in the appended claims.

What is claimed is:

1. A scrubber device for mounting onto a shoe worn by a person using the device, said scrubber device comprising: a sole plate including a base having a plurality of openings formed therein, and a scrubber pad of a selected porous scrubber material mounted on said base;

a toe upper mounted on said sole plate, said toe upper and said sole plate cooperatively defining a rearwardly open cavity for receiving the ball and toe region of the user's shoe, with said toe upper extending generally over the shoe toe region and with said sole plate generally underlying the ball and toe region of the user's shoe; and strap means extending rearwardly from said sole plate to wrap about the heel of the user's shoe to retain the scrubber device mounted securely on the shoe.

2. The scrubber device of claim 1 wherein said base has an upper roughened textured surface formed thereon.

3. The scrubber device of claim 1 wherein said base comprises a plurality of longitudinally extending, generally parallel spaced base strips.

4. The scrubber device of claim 1 further including an upstanding side strip of scrubber material mounted along opposite sides of said sole plate.

5. The scrubber device of claim 1 wherein said toe upper and said sole plate cooperatively define a generally pointed toe, and further including scrubber material mounted on said pointed toe.

6. The scrubber device of claim 1 wherein said strap means is adjustable in length.

7. The scrubber device of claim 1 wherein said strap means is elastic.

8. A scrubber device for mounting onto a shoe worn by a person using the device, said scrubber device comprising:

a sole plate including a selected scrubber material;

a toe upper mounted on said sole plate, said toe upper and said sole plate cooperatively defining a rearwardly open cavity for receiving the ball and toe region of the user's shoe, with said toe upper extending generally over the shoe toe region and with said sole plate generally underlying the ball and toe region of the user's shoe;

strap means extending rearwardly from said sole plate to wrap about the heel of the user's shoe to retain the scrubber device mounted securely on the shoe; and an upstanding side rim extending along opposite sides of said sole plate and cooperating with said toe upper and said sole plate to define said rearwardly open cavity, said side rim having scrubber means mounted thereon.

9. The scrubber device of claim 8 wherein said toe upper and said sole plate cooperatively define a generally pointed toe, and further including scrubber material mounted on said pointed toe.

10. A scrubber device for mounting onto a shoe worn by a person using the device, said scrubber device comprising:

a sole plate including a base having a roughened texture upper surface and a lower surface with a scrubber pad mounted thereon;

a toe upper on said sole plate and cooperating therewith to define a rearwardly open cavity for receiving the ball and toe region of the user's shoe, and including a pair of upstanding side rims extending along opposite sides of the sole plate;

strap means extending rearwardly from said sole plate to wrap about the heel of the user's shoe to retain the scrubber device mounted securely on the shoe;

said toe upper and sole plate further defining a forwardly extending, generally pointed toe; and a side strip of scrubber material mounted on said pointed toe and said side rims to extend from said pointed toe along opposite sides of said sole plate.

11. The scrubber device of claim 10 wherein said base has a plurality of holes forward therein, and wherein said pad is formed from a porous material.

12. The scrubber device of claim 10 wherein said pad is formed from an abrasive scrubber material.

* * * * *